US009275589B2

(12) United States Patent
Hu et al.

(10) Patent No.: US 9,275,589 B2
(45) Date of Patent: Mar. 1, 2016

(54) GATE DRIVE CIRCUIT, ARRAY SUBSTRATE AND DISPLAY APPARATUS

(71) Applicants: BOE Technology Group Co., Ltd., Beijing (CN); Chengdu BOE Optoelectronics Technology Co., Ltd., Chengdu (CN)

(72) Inventors: Like Hu, Beijing (CN); Xiaojing Qi, Beijing (CN)

(73) Assignees: BOE Technology Group Co., Ltd., Beijing (CN); Chengdu BOE Optoelectronics Technology Co., Ltd., Chengdu (CN)

( * ) Notice: Subject to any disclaimer, the term of this patent is extended or adjusted under 35 U.S.C. 154(b) by 0 days.

(21) Appl. No.: 14/143,423

(22) Filed: Dec. 30, 2013

(65) Prior Publication Data

US 2014/0204011 A1 Jul. 24, 2014

(30) Foreign Application Priority Data

Jan. 23, 2013 (CN) ..... 2013 1 0024400

(51) Int. Cl.
*G09G 3/36* (2006.01)

(52) U.S. Cl.
CPC ..... *G09G 3/3611* (2013.01); *G09G 3/3655* (2013.01)

(58) Field of Classification Search
None
See application file for complete search history.

(56) References Cited

U.S. PATENT DOCUMENTS

| | | | | |
|---|---|---|---|---|
| 5,883,827 | A * | 3/1999 | Morgan | G11C 13/0004 365/100 |
| 7,872,506 | B2 | 1/2011 | Chien et al. | |
| 8,289,261 | B2 | 10/2012 | Lee et al. | |
| 8,742,446 | B2 | 6/2014 | Yamada et al. | |
| 2006/0181502 | A1 * | 8/2006 | Kubota | G09G 3/3677 345/100 |
| 2008/0165112 | A1 * | 7/2008 | Su | G09G 3/3677 345/100 |

(Continued)

FOREIGN PATENT DOCUMENTS

| | | | |
|---|---|---|---|
| CN | 101937655 | A | 1/2011 |
| CN | 102054937 | A | 5/2011 |

(Continued)

OTHER PUBLICATIONS

First Chinese Office Action (including Search Report and English translation) for Chinese Patent Application No. CN 201310024400.1, dated Jul. 30, 2014, 14 pages.

(Continued)

*Primary Examiner* — Jason Olson
*Assistant Examiner* — Krishna Neupane
(74) *Attorney, Agent, or Firm* — Westman, Champlin & Koehler, P.A.

(57) ABSTRACT

A gate drive circuit, comprising: a plurality of shift register units each having a signal output end, wherein the signal output end of one of the plurality of shift register units except the last one is connected to the signal input end of the next one; L arithmetic units each having a plurality of input ends, wherein L is an integer equal to or larger than 2, and one of the plurality of input ends of each of the L arithmetic units is connected to the signal output end of a respective shift register unit; and a clock generation unit having a plurality of clock output ends for outputting different clock signals, wherein at least one of the plurality of clock output ends is connected to at least one of the other input ends of a respective arithmetic unit except the one input end connected to the signal output end of the shift register unit, so that the L arithmetic units output L different drive signals.

15 Claims, 6 Drawing Sheets

(56) References Cited

U.S. PATENT DOCUMENTS

| | | | | |
|---|---|---|---|---|
| 2012/0293536 | A1* | 11/2012 | Yonemaru ..... | G09G 3/3648 345/589 |
| 2014/0077171 | A1 | 3/2014 | Yamakita et al. | |

FOREIGN PATENT DOCUMENTS

| | | | |
|---|---|---|---|
| CN | 102324221 | A | 1/2012 |
| CN | 102881248 | A | 1/2013 |
| CN | 103325812 | A | 9/2013 |
| EP | 0 146 865 | A2 | 7/1985 |
| JP | 2002-132203 | A | 5/2002 |
| JP | 2010-61130 | A | 3/2010 |
| JP | 2010-113343 | A | 5/2010 |

OTHER PUBLICATIONS

Second Chinese Office Action for Chinese Patent Application No. 201310024400.1, dated Feb. 28, 2015, 12 pages.

Decision of Rejection for Chinese Patent Application No. 201410240373.6, dated Jun. 3, 2015, 12 pages.

Third Office Action for Chinese Patent Application No. 20131002440.1, dated Jul. 28, 2015, 15 pages.

"Drive and Design of TFT LCD panel", Yaxiang, Dai, p. 127, Tsinghua University Press, Sep. 2011, 1 page.

"Design of Integrated Circuits for Optical communications", Zhigong, Wang, pp. 273-274, Higher Education Press, Jun. 2003, 2 pages.

Rejection Decision for Chinese Patent Application No. 201310024400.1, dated Dec. 10, 2015, 11 pages.

* cited by examiner

GATE DRIVE CIRCUIT, ARRAY SUBSTRATE AND DISPLAY APPARATUS

CROSS-REFERENCE TO RELATED APPLICATION

This application claims the benefit of Chinese Patent Application No. 201310024400.1 filed on Jan. 23, 2013 in the State Intellectual Property Office of China, the whole disclosure of which is incorporated herein by reference.

BACKGROUND OF THE INVENTION

1. Field of the Invention

The present invention relates to a technical field of a display, more particularly, relates to a gate drive circuit, an array substrate and a display apparatus.

2. Description of the Related Art

FIG. 1 shows an illustrative view of a conventional gate drive circuit. In prior arts, a display apparatus generally comprises the conventional gate drive circuit of FIG. 1.

As shown in FIG. 1, the gate drive circuit comprises a plurality of shift register units and a plurality of output buffer units. The plurality of shift register units are connected in series. Each of the shift register units may output a gate pulse signal to a respective output buffer unit, so that the output buffer unit outputs a gate drive signal. The signal output from one of the plurality of shift register units also functions as a start signal of a next shift register unit.

Referring to FIG. 1, one of the shift register units shifts a start signal STV_N and outputs a shifted signal STV_N+1. The shifted signal STV_N+1 is input into the output buffer unit, and the output buffer unit outputs a gate drive signal Gate_N+1. In addition, the shifted signal STV_N+1 also is input into the next shift register unit as the start signal of the next shift register unit. The next shift register unit shifts the shifted signal STV_N+1 and outputs a next shifted signal STV_N+2. The next shifted signal STV_N+2 is input into a next output buffer unit, and the next output buffer unit outputs a gate drive signal Gate_N+2.

So far, in order to increase a display region of a small display apparatus and improve a display effect of a large display apparatus, it is necessary to reduce a width of an edge frame extending from an edge of the display region to the outer edge of the display apparatus so as to obtain a narrow edge frame. However, in the gate drive circuit shown in FIG. 1, if it needs to output N gate drive signals, then N shift register units must be connected in series, causing a wiring area of the gate drive circuit very large, and increasing the width of the edge frame. As a result, it is difficult to obtain a display apparatus with a narrow edge frame.

SUMMARY OF THE INVENTION

The present invention has been made to overcome or alleviate at least one aspect of the above mentioned disadvantages.

Accordingly, it is an object of the present invention to provide a gate drive circuit, an array substrate and a display apparatus that can reduce a wiring area and achieve a narrow edge frame.

According to an aspect of the present invention, there is provided a gate drive circuit, comprising:

a plurality of shift register units each having a signal output end, wherein the signal output end of one of the plurality of shift register units except the last one is connected to the signal input end of the next one;

L arithmetic units each having a plurality of input ends, wherein L is an integer equal to or larger than 2, and one of the plurality of input ends of each of the L arithmetic units is connected to the signal output end of a respective shift register unit; and a clock generation unit having a plurality of clock output ends for outputting different clock signals, wherein at least one of the plurality of clock output ends is connected to at least one of the other input ends of a respective arithmetic unit except the one input end connected to the signal output end of the shift register unit, so that the L arithmetic units output L different drive signals.

According to another aspect of the present invention, there is provided an array substrate, comprising:

a plurality of gate lines and a plurality of data lines;

a plurality of thin film transistors formed in a plurality of pixel regions defined by the plurality of gate lines and the plurality of data lines, respectively; and a gate drive circuit, according to the above embodiment, configured to provide a drive signal for the gate lines.

According to another aspect of the present invention, there is provided a display apparatus comprising the above array substrate.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF PREFERRED EMBODIMENTS OF THE INVENTION

Figure 1:
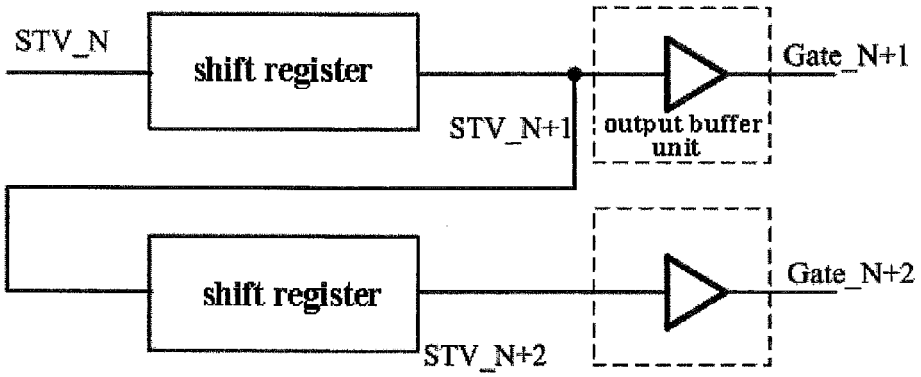
FIG. 1 is an illustrative principle frame view of a conventional gate drive circuit in prior arts.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

According to a general concept of the present invention, there is provided a gate drive circuit, comprising: a plurality of shift register units each having a signal output end, wherein the signal output end of one of the plurality of shift register units except the last one is connected to the signal input end of the next one; L arithmetic units each having a plurality of input ends, wherein L is an integer equal to or larger than 2, and one of the plurality of input ends of each of the L arithmetic units is connected to the signal output end of one respective shift register unit; and a clock generation unit having a plurality of clock output ends for outputting different clock signals, wherein at least one of the plurality of clock output ends is connected to at least one of the other input ends of one respective arithmetic unit except the one input end connected to the signal output end of the shift register unit, so that the L arithmetic units output L different drive signals.

Figure 2:
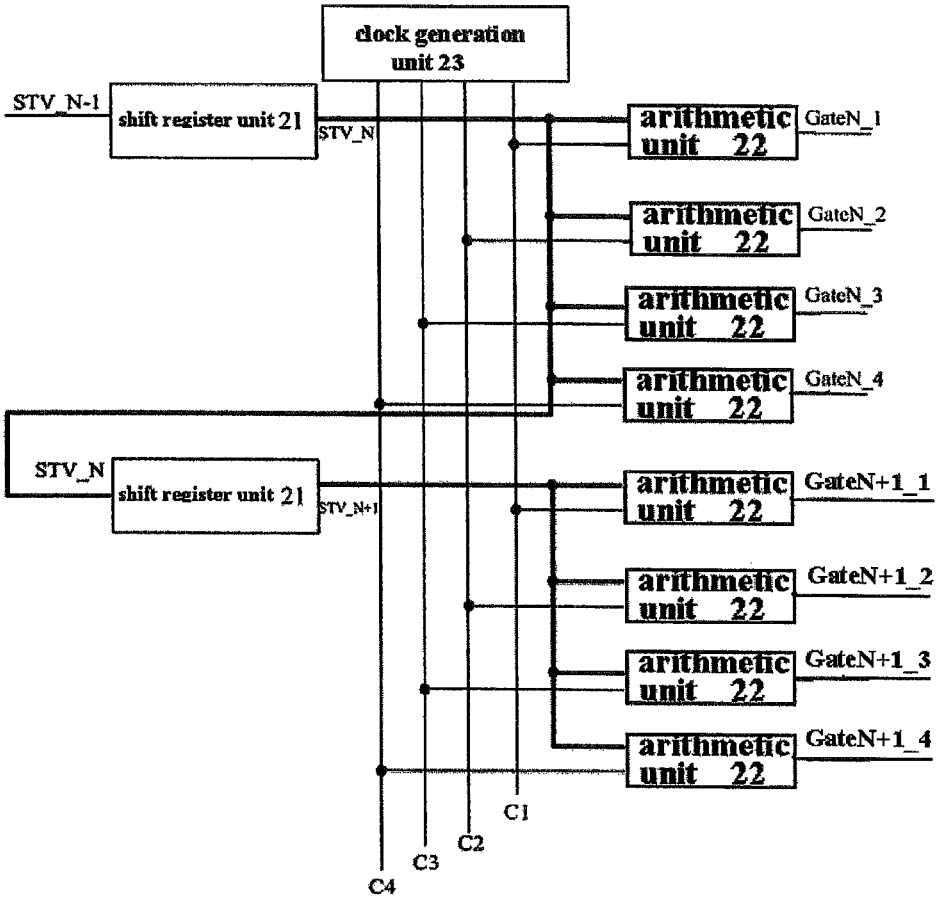
FIG. 2 is a principle block diagram of a part of a gate drive circuit according to a first exemplary embodiment of the present invention.

In an exemplary embodiment of the present invention, as shown in FIG. 2, the gate drive circuit comprises a plurality of shift register units 21 each having a signal output end. The signal output end of one of the plurality of shift register units 21, except the last shift register unit, is connected to a signal input end of a next shift register unit. Each of the shift register units 21 corresponds to L arithmetic units 22 and is connected to the L arithmetic units 22.

Each of the L arithmetic units 22 has at least two input ends. The arithmetic unit 22 is configured to calculate at least two signals input from the at least two input ends. L is an integer equal to or larger than 2. In an exemplary embodiment, as shown in FIG. 2, L=4. That is, each of the shift register units 21 corresponds to four arithmetic units 22. More specifically, one of the plurality of input ends of each of the L arithmetic units 22 is connected to the signal output end of a respective shift register unit 21. The gate drive circuit further comprises a clock generation unit 23 having a plurality of clock output ends for outputting different clock signals. At least one of the plurality of clock output ends is connected to at least one of the other input ends of a respective arithmetic unit 22 except the one input end connected to the signal output end of the shift register unit. The clock output ends of the clock generation unit 23 output different clock signals to the other input ends of the L arithmetic units 22, respectively, so that the L arithmetic units output L different drive signals.

In an exemplary embodiment of the present invention, the shift register unit may comprise a shift register, and the clock generation unit may comprise an integrated circuit. Please be noted that the arithmetic unit herein may be a logic unit.

In an exemplary embodiment of the gate drive circuit of the present invention, an input signal of a first shift register unit may be provided by an integrated circuit provided on a substrate of a display apparatus, and the input ends of the other shift register units except the first shift register unit each receives the output signal from the previous shift register unit. In an exemplary embodiment of the present invention, as shown in FIG. 2, the arithmetic unit has two input ends.

Figure 3:
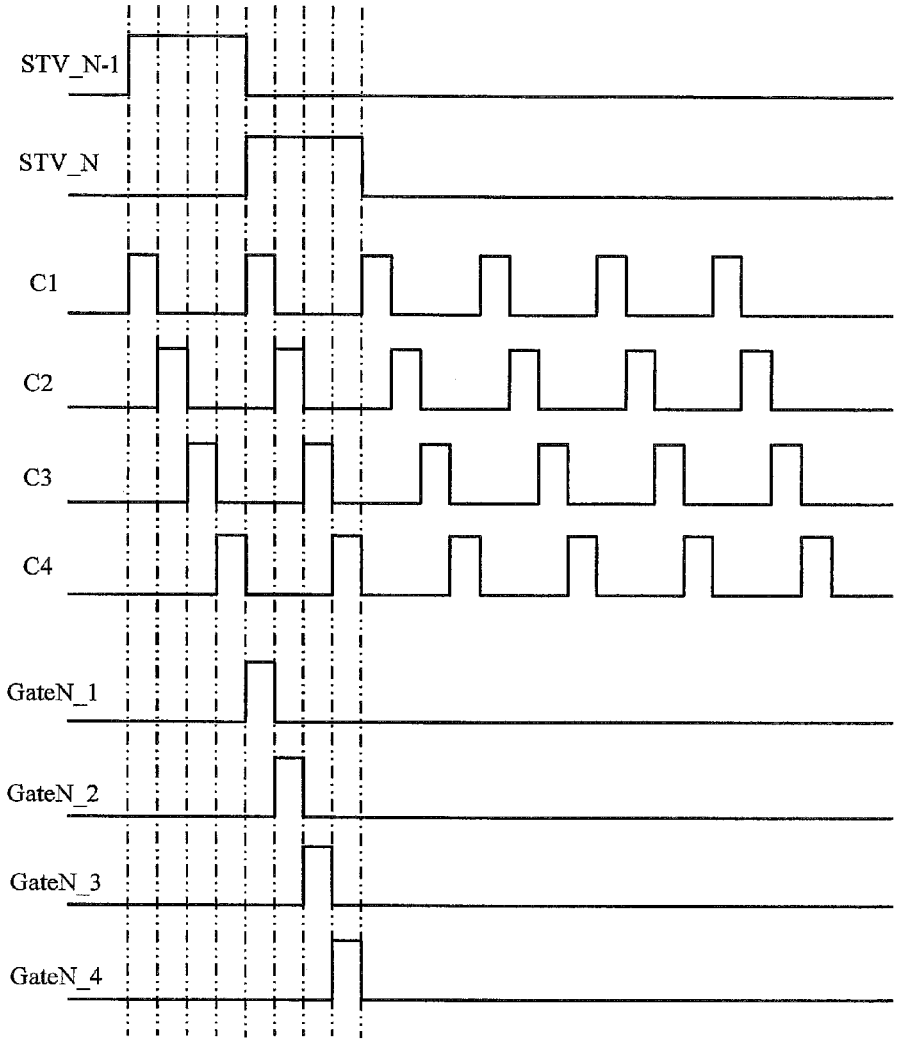
FIG. 3 is an illustrative drive sequence diagram of the gate drive circuit of FIG. 2 according to an exemplary embodiment of the present invention.

FIG. 3 is an illustrative drive sequence diagram of the gate drive circuit of FIG. 2 according to an exemplary embodiment of the present invention.

As shown in FIGS. 2-3, an input signal STV_N−1 is input into the $(N-1)^{th}$ shift register unit 21, and the $(N-1)^{th}$ shift register unit 21 shifts the input signal STV_N−1 and outputs an output signal STV_N. The clock generation unit 23 generates 4 clock signals. C1, C2, C3, C4 as shown in FIG. 3. Each of the 4 arithmetic units 22 connected to the $(N-1)^{th}$ shift register unit 21 performs a logic calculation based on the output signal STV_N of the $(N-1)^{th}$ shift register unit 21 and a respective one of the 4-way clock signals C1, C2, C3, C4, so that the 4 arithmetic units 22 connected to the $(N-1)^{th}$ shift register unit 21 generate 4 gate drive signals GateN_1, GateN_2, GateN_3, GateN_4, as shown in FIG. 3. The input end of the $N^{th}$ shift register unit receives and shifts the output signal STV_N from the $(N-1)^{th}$ shift register unit 21 and outputs an output signal STV_N+1. As shown in FIG. 2, each of the 4 arithmetic units 22 connected to the $N^{th}$ shift register unit 21 performs a logic calculation based on the output signal STV_N+1 of the $N^{th}$ shift register unit 21 and a respective one of the 4 clock signals C1, C2, C3, C4, so that the 4 arithmetic units 22 connected to the $N^{th}$ shift register unit 21 generate 4 gate drive signals GateN+1_1, GateN+1_2, GateN+1_3, GateN+1_4 associated with the $N^{th}$ shift register unit 21. In this way, each of the shift register units outputs 4 different gate drive signals. In prior arts, each of the shift register units can output only a single gate drive signal, therefore, it needs four shift register units to generate 4 gate drive signals. However, in the present invention, it needs only a single shift register unit to generate 4 gate drive signals.

In an exemplary embodiment of the gate drive circuit of the present invention, the L arithmetic units perform the logic calculation according to the output signal of the shift register unit and the different clock signals, thereby outputting the plurality of gate drive signals. In this way, the number of the shift register units in the gate drive circuit of the present invention can be reduced to 1/L of the number of the shift register units in the conventional gate drive circuit in prior arts, thereby reducing the wiring area of the gate drive circuit, decreasing the width of the edge frame of the display apparatus, and achieving the narrow edge frame.

It should be appreciated for those skilled in this art that the arithmetic unit 22 may be configured in various logic circuits as long as the L arithmetic units 22 can logically calculate the input signals and output the drive signals. Optionally, the arithmetic unit may have two, three or more input ends.

Figure 6:
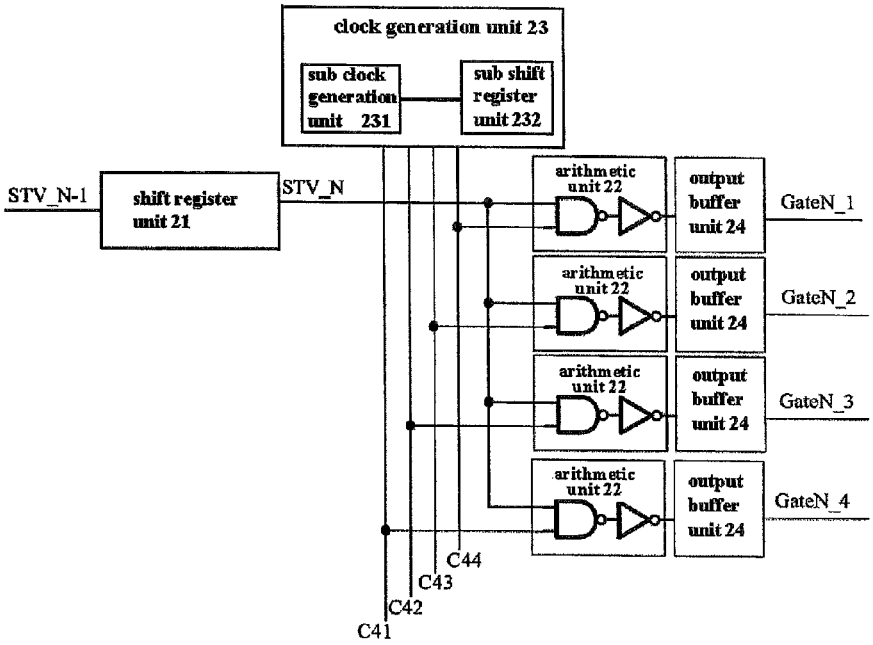
FIG. 6 is a principle block diagram of a part of the gate drive circuit of FIG. 2 according to an exemplary embodiment of the present invention.

In an exemplary embodiment, each of the arithmetic units 22 has two input ends. In addition, each of the L arithmetic units may comprises a NAND gate and a NOT gate that are connected in series. In another exemplary embodiment, each of the arithmetic units 22 may comprise a NAND gate, and an odd number of NOT gates that are connected in series. For example, as shown in FIG. 6, the arithmetic unit 22 may comprise a NAND gate having two input ends and a NOT gate connected to the NAND gate in series. One of the input ends of each of the L arithmetic units is connected to the signal output end of the respective shift register unit. The other of the input ends of each of the L arithmetic units is connected to the respective output end of the clock generation unit 23. At this time, as shown in FIGS. 2-3, each of the L arithmetic units 22 performs a logic calculation on the output signal STV_N of the $(N-1)^{th}$ shift register unit 21 and the respective one of the 4 clock signals C1, C2, C3, C4 shown in FIG. 3, so that the 4 gate drive signals GateN_1, GateN_2, GateN_3, GateN_4 are generated by 4 arithmetic unit, as shown in FIG. 3.

Figure 4:
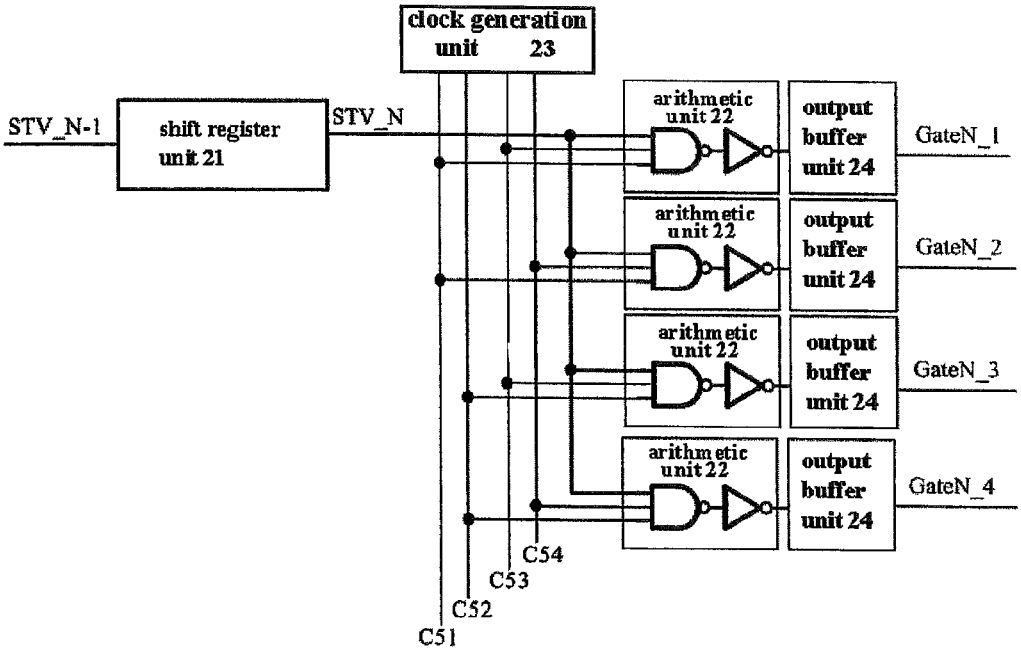
FIG. 4 is a principle block diagram of a part of a gate drive circuit according to a second exemplary embodiment of the present invention.

In a second exemplary embodiment of the present invention, as shown in FIG. 4, each of the L arithmetic units 22 has three input ends. In addition, each of the L arithmetic units 22 comprises a NAND gate having three input ends and a NOT gate connected to the NAND gate in series. One of the input ends of each of the L arithmetic units 22 is connected to the signal output end of the respective shift register unit. The other input ends of each of the L arithmetic units 22 are connected to respective output ends of the clock generation unit 23 as long as the L arithmetic units 22 can output different drive signals.

Figure 5:
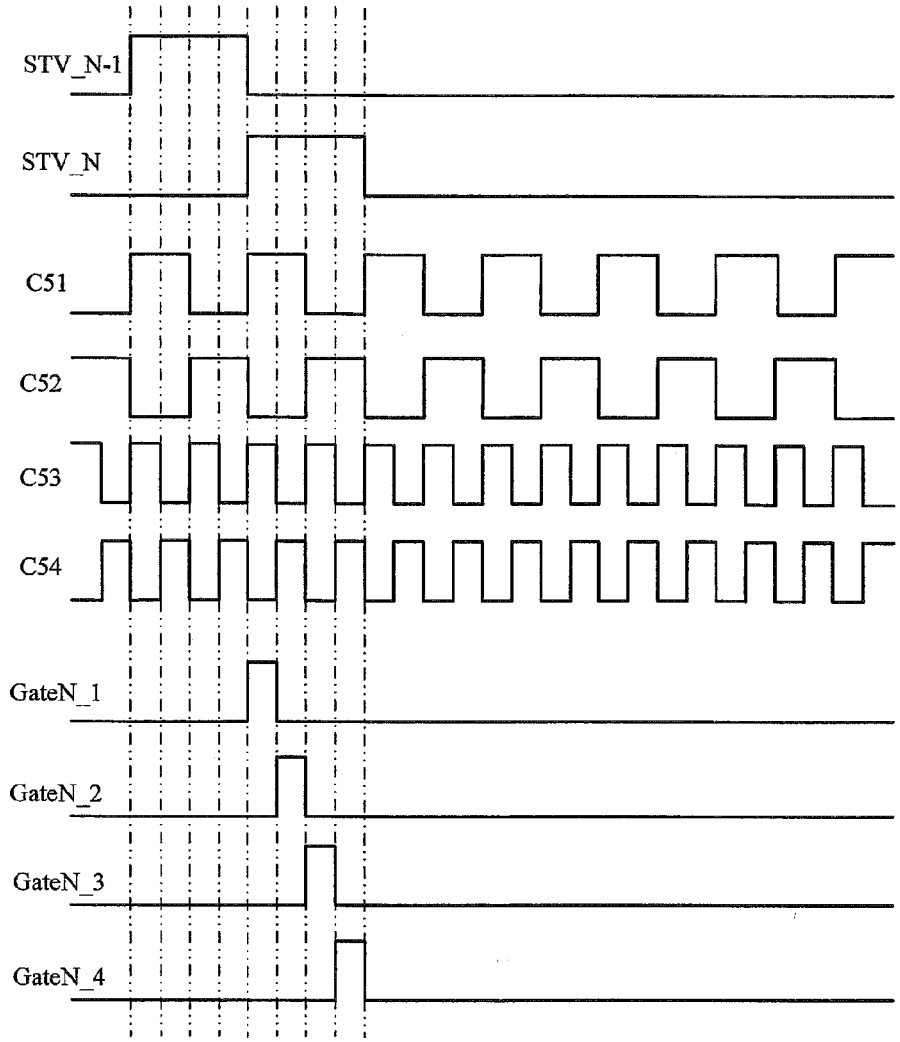
FIG. 5 is an illustrative drive sequence diagram of the gate drive circuit of FIG. 4 according to an exemplary embodiment of the present invention.

FIG. 4 is a principle block diagram of a part of a gate drive circuit according to a second exemplary embodiment of the present invention; FIG. 5 is an illustrative drive sequence diagram of the gate drive circuit of FIG. 4 according to an exemplary embodiment of the present invention.

As shown in FIGS. 4-5, each of the L arithmetic units 22 performs a logic calculation based on the output signal STV_N of the $(N-1)^{th}$ shift register unit 21 and the respective two of the 4 clock signals C51, C52, C53, C54 shown in FIG. 5, and generates the 4 gate drive signals GateN_1, GateN_2, GateN_3, GateN_4, as shown in FIG. 5.

In an exemplary embodiment, as shown in FIG. 5, the first way arithmetic unit 22 performs a logic calculation on the signal STV_N and the clock signals C51, C53. The calculation result of the first arithmetic unit 22 is output to the first buffer unit 24, and the first buffer unit 24 generates the output signal GateN_1 Similarly, the second arithmetic unit 22 performs a logic calculation on the signal STV_N and the clock signals C51, C54. The calculation result of the second arithmetic unit 22 is output to the second buffer unit 24, and the second buffer unit 24 generates the output signal GateN_2. Similarly, the third arithmetic unit 22 performs a logic calculation on the signal STV_N and the clock signals C52, C53. The calculation result of the third arithmetic unit 22 is output to the third buffer unit 24, and the third buffer unit 24 generates the output signal GateN_3. Similarly, the fourth arithmetic unit 22 performs a logic calculation on the signal STV_N and the clock signals C52, C54. The calculation result of the fourth arithmetic unit 22 is output to the fourth buffer unit 24, and the fourth buffer unit 24 generates the output signal GateN_4.

In an exemplary embodiment, in order to amplify the drive ability of the drive signals of the gate drive circuit, as shown in FIG. 4 or FIG. 6, the output end of each of the arithmetic units 22 in the gate drive circuit is connected with an output buffer unit 24. Optionally, each of the output buffer units 24 may comprise an even number of inverters connected in series.

The clock generation unit 23 commonly can provide 2, 3, 4, 5 or 6 different clock signals. Of course, the clock generation unit 23 may provide 7 or more different clock signals, however, it complicates the clock signals and decreases the practicability of the clock signals.

In an exemplary embodiment, in order to increase the number of the clock signals and reduce the number of the shift register units 21, as shown in FIG. 6, the clock generation unit 23 may comprise a sub clock generation unit 231 and a sub shift register unit 232. In an exemplary embodiment, L clock output ends of the clock generation unit 23 consist of first clock output ends of the sub clock generation unit 231 and second clock output ends of the sub shift register unit 232. The sub clock generation unit 231 is configured to generate m different first clock signals ($m \geq 1$ and $m < L$) and output the m first clock signals through the first clock output ends. The input end of the sub shift register unit 232 is connected to the output end of the sub clock generation unit 231 and configured to shift the m first clock signals generated by the sub clock generation unit 231 so as to generate (L−m) different second clock signals and output the (L−m) different second clock signals through the second clock output ends.

Figure 7:
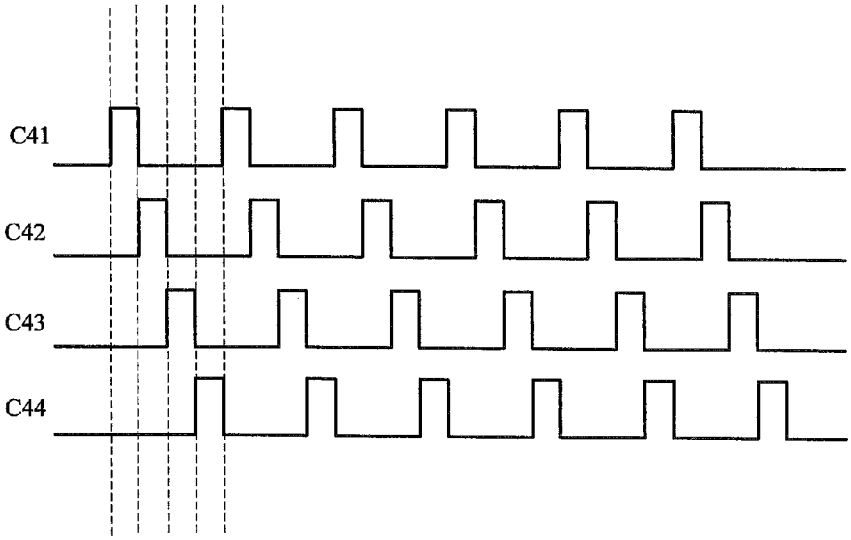
FIG. 7 is an illustrative sequence diagram of clock signals generated by a clock generation unit in the gate drive circuit of FIG. 6.

In an exemplary embodiment, as shown in FIG. 6, four clock output ends of the clock generation unit 23 consist of two first clock output ends of the sub clock generation unit 231 and two second clock output ends of the sub shift register unit 232. The sub clock generation unit 231 generates two different first clock signals C41, C42 and outputs the two different first clock signals C41, C42 through the first clock output ends. The sub shift register unit 232 shifts the first clock signals C41, C42 and outputs the second clock signals C43, C44 through the second clock output ends. In another exemplary embodiment, the sub clock generation unit 231 may generate two different first clock signals C41, C43 and output the two different first clock signals C41, C43 through the first clock output ends. The sub shift register unit 232 may shift the first clock signals C41, C43 and output the second clock signals C42, C44 through the second clock output ends. FIG. 7 shows the sequence diagram of clock signals C41, C42, C43, C44 generated by the clock generation unit 23 in the gate drive circuit of FIG. 6.

In this way, by using the shift register sub unit 232, the number of the clock signals output from the clock generation unit 23 can be doubled, and the number of the shift register units can be further reduced by half, thereby decreasing the wiring area, narrowing the edge frame of the display apparatus, and facilitating to achieve the narrow edge frame.

When the above gate drive circuit is applied in the display apparatus, it is necessary to pre-design the pulse width and the period of the clock signal. In an exemplary embodiment of the present invention, as shown in FIG. 2 or FIG. 6, the pulse width of the clock signal of the clock generation unit 23 is set as 1/L of the pulse width of the output signal of the shift register unit, and the period of the clock signal of the clock generation unit 23 is set equal to the pulse width of the output signal of the shift register unit. As shown in FIG. 3, if L=4, the clock generation unit 23 outputs 4 clock signals C1, C2, C3, C4. The pulse width of each of the 4 clock signals C1, C2, C3, C4 is equal to ¼ of the pulse width of the output signal STV_N of the shift register unit 21, and the period of each of the 4 clock signals C1, C2, C3, C4 is equal to the pulse width of the output signal STV_N of the shift register unit 21.

In an exemplary embodiment, as shown in FIGS. 4-5, the clock signal C52 may be formed by inverting the clock signal C51, and the clock signal C54 may be formed by inverting the clock signal C53. In this way, the number of the clock signals directly generated by the clock generation unit 23 can be reduced. In an exemplary embodiment, the period of the clock signals C51, C52 may be equal to the pulse width of the output signal STV_N, and the pulse width of the clock signals C51, C52 may be equal to ½ of the pulse width of the output signal STV_N; the period of the clock signals C53, C54 may be equal to the pulse width of the clock signals C51, C52, and the pulse width of the clock signals C53, C54 may be equal to ½ of the pulse width of the clock signals C51, C52. In this way, upon the input signal STV_N−1 is inputted into the gate drive circuit of FIG. 4, the gate drive circuit can output a plurality of different drive signals.

According to an exemplary embodiment of the present invention, there is also provided an array substrate, comprising: a plurality of gate lines and a plurality of data lines; a plurality of thin film transistors formed in a plurality of pixel regions defined by the plurality of gate lines and the plurality of data lines, respectively; and a gate drive circuit, according to the above embodiments, configured to provide a drive signal for the gate lines.

According to an exemplary embodiment of the present invention, there is also provided a display apparatus comprising the above array substrate. The display apparatus may be any product or member having the display function, such as, a liquid crystal display, a liquid crystal TV, a digital camera, a mobile telephone, a panel computer, and so on.

In the gate drive circuit, the array substrate and the display apparatus according to the above various embodiments, the arithmetic units perform the logic calculation on the output signal of the shift register unit and the different clock signals and output multi-way gate drive signals, thereby reducing the number of the shift register units used in the gate drive circuit, decreasing the wiring area of the gate drive circuit, narrowing the width of the edge frame of the display apparatus, and facilitating to achieve the narrow edge frame.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A gate drive circuit, comprising:

a plurality of shift register units each having a signal output end, wherein the signal output end of one of the plurality of shift register units except the last one is connected to the signal input end of the next one;

L arithmetic units each having a plurality of input ends, wherein L is an integer equal to or larger than 2, and one of the plurality of input ends of each of the L arithmetic units is connected to the signal output end of a respective shift register unit; and a clock generation unit having a plurality of clock output ends for outputting different clock signals, wherein at least one of the plurality of clock output ends is connected to at least one of the other input ends of a respective arithmetic unit except the one input end connected to the signal output end of the shift register unit, so that the L arithmetic units output L different drive signals, wherein the clock generation unit comprising:

a sub clock generation unit configured to generate m different first clock signals and output the m first clock signals through m first clock output ends of the plurality of clock output ends, wherein m is an integer equal to or larger than 1 and less than L; and a sub shift register unit connected to the sub clock generation unit and configured to shift the m first clock signals generated by the sub clock generation unit so as to generate (L−m) different second clock signals and output the (L−m) different second clock signals through (L−m) second clock output ends of the plurality of clock output ends, wherein at least one of the first clock output ends and the second clock output ends is connected to the at least one of the other input ends of each of the L arithmetic unit, so that L clock output ends of the clock generation unit consist of first clock output ends of the sub clock generation unit and second clock output ends of the sub shift register unit.

2. The gate drive circuit according to claim 1, wherein each of the L arithmetic units comprising:

a NAND gate having two input ends; and a NOT gate connected to the NAND gate in series.

3. The gate drive circuit according to claim 1, wherein each of the L arithmetic units comprising:

a NAND gate having three input ends; and a NOT gate connected to the NAND gate in series.

4. The gate drive circuit according to claim 1, wherein the output end of each of the L arithmetic units is connected with an output buffer unit.

5. The gate drive circuit according to claim 4, wherein each of the output buffer units comprises an even number of inverters connected in series.

6. The gate drive circuit according to claim 1, wherein L is 2 or 4.

7. The gate drive circuit according to claim 2, wherein the clock signals each has a pulse width equal to 1/L of a pulse width of a signal output from the signal output end of the shift register unit; and wherein the clock signals each has a period equal to the pulse width of the signal output from the signal output end of the shift register unit.

8. An array substrate, comprising:

a plurality of gate lines and a plurality of data lines;

a plurality of thin film transistors formed in a plurality of pixel regions defined by the plurality of gate lines and the plurality of data lines, respectively; and a gate drive circuit according to claim 1, configured to provide a drive signal for the gate lines.

9. The array substrate according to claim 8, wherein each of the L arithmetic units comprising:

a NAND gate having two input ends; and a NOT gate connected to the NAND gate in series.

10. The array substrate according to claim 8, wherein each of the L arithmetic units comprising:

a NAND gate having three input ends; and a NOT gate connected to the NAND gate in series.

11. The array substrate according to claim 8, wherein the output end of each of the L arithmetic units is connected with an output buffer unit.

12. The array substrate according to claim 11, wherein each of the output buffer units comprises an even number of inverters connected in series.

13. The array substrate according to claim 8, wherein L is 2 or 4.

14. The array substrate according to claim 9, wherein the clock signals each has a pulse width equal to 1/L of a pulse width of a signal output from the signal output end of the shift register unit; and wherein the clock signals each has a period equal to the pulse width of the signal output from the signal output end of the shift register unit.

15. A display apparatus, comprising an array substrate according to claim 8.

* * * * *